US005172138A

United States Patent [19]

Okazawa et al.

[11] Patent Number: 5,172,138

[45] Date of Patent: Dec. 15, 1992

[54] POSITIONING APPARATUS FOR A MOVABLE MEMBER SUCH AS A SHEET GUIDE MEMBER

[75] Inventors: Kazuhiko Okazawa, Kawasaki; Toshiyuki Itoh, Sagamihara; Kaoru Sato; Tatsuto Tachibana, both of Yokohama; Akihisa Kusano, Kawasaki, all of Japan

[73] Assignee: Canon Kabushiki Kaisha, Tokyo, Japan

[21] Appl. No.: 658,233

[22] Filed: Feb. 20, 1991

[30] Foreign Application Priority Data

Feb. 23, 1990 [JP] Japan ..... 2-43577

[51] Int. Cl.[5] ..... B41J 2/05

[52] U.S. Cl. ..... 346/134; 271/240; 271/255; 346/139 R; 346/140 R; 318/466; 318/468

[58] Field of Search ..... 346/140, 139, 134; 318/466, 467, 468, 476, 480, 696, 688; 271/255, 253, 240

[56] References Cited

U.S. PATENT DOCUMENTS

| | | | |
|---|---|---|---|
| 4,627,043 | 12/1986 | Uehara | 369/215 |
| 4,723,129 | 2/1988 | Endo | 346/140 X |
| 4,888,531 | 12/1989 | Hormann | 318/468 X |
| 4,907,792 | 3/1990 | Washiashi | 271/253 X |

FOREIGN PATENT DOCUMENTS

| | | |
|---|---|---|
| 61-7157 | 1/1986 | Japan . |
| 63-185757 | 8/1988 | Japan . |
| 169436 | 3/1989 | Japan . |

OTHER PUBLICATIONS

IBM Technical Disclosure Bulletin, Jul. 1989, pp. 56–58, vol. 32, No. 2, "Electronic Backlash Compensation for Serial Printers" 3 pp. European Search Report.

*Primary Examiner*—Joseph W. Hartary

*Attorney, Agent, or Firm*—Fitzpatrick, Cella, Harper & Scinto

[57] ABSTRACT

A positioning apparatus for positioning a reciprocally movable member, such as a guide member for a sheet of recording paper, between a reference position and a predetermined position. The apparatus includes a detector for detecting that the movable member is in the proximity of the reference position, and a counter for counting the amount by which the movable member is shifted while the detector is detecting that the movable member is in the proximity of the reference position. A controller stores the value counted by the counter, and controls drive of the movable member when the movable member is being returned to the reference position based on the count in the counter and the stored count value. A second counter may be provided to count the amount by which the movable member is shifted from the reference position to the predetermined position.

17 Claims, 9 Drawing Sheets

POSITIONING APPARATUS FOR A MOVABLE MEMBER SUCH AS A SHEET GUIDE MEMBER

BACKGROUND OF THE INVENTION

1. Field of the Invention

The present invention relates to a positioning apparatus for positioning a movable member, and more particularly, it relates to a positioning apparatus used with a sheet feeding system of a copying machine, printer and the like. Particularly, the present invention relates to a positioning apparatus including a movable member for permitting the guide of a plurality of kinds of sheets having different widths.

2. Related Background Art

In the past, in order to permit the guide of sheets having different widths, in an apparatus such as a copying machine, a mechanism for positioning the sheet in its transverse (width) direction included a sensor disposed reference position regarding the positioning of the sheet so that the movable member returned to the reference position was detected by the sensor to stop a stepping motor. And, when a sheet having a different width was sent to the positioning mechanism, the stepping motor was driven again under the time control or pulse control to shift the movable member from the reference position to a predetermined position, thus positioning the movable member with respect to the sheet to be guided.

However, in such conventional positioning mechanism, since, for example, a photo-interrupter is used as the sensor arranged at the reference position and a width of each slit of such photo-interrupter is about 0.5 mm, the error at the reference position is at least 0.5 mm or more. Further, since the error in the attachment of the sensor, angular error in the stepping motor, dimensional error in the movable member and the like are added, the positioning error will be greater.

In an image forming apparatus such as a copier or the like, to enhance the accuracy of the position at which an image is formed, the positioning of the sheet is effected in a main scanning direction. However, when the aforementioned conventional positioning mechanism is used, the positioning error is too great to position the movable member correctly, as mentioned above, thus arising a problem that the deviation of the image from the correct image forming position is noticeable.

SUMMARY OF THE INVENTION

The present invention aims to eliminate the above-mentioned conventional drawback, and an object of the present invention is to provide a positioning apparatus which can correctly position a movable member.

In order to achieve the above object, the present invention provide a positioning apparatus comprising a reciprocally movable member; a drive means for reciprocally shifting the movable member between a reference position and an operative position; a detection means for detecting the fact that the movable member is situated in the proximity of the reference position; a counting means for counting a shifting amount of the movable member while the detection means is detecting the movable member when the movable member is shifting from the reference position to the operative position; and a control means for storing a counted value counted by the counting means and for controlling the stop of the drive means on the basis of the counted value when the movable member is returned to the reference position and stopped there.

With this arrangement according to the present invention, it is possible to correctly shift the movable member to the reference position, thus providing a positioning apparatus which can avoid the noise due to out-of-phase of a motor, because, by performing the count-down, the timing that the movable member is abutted against a regulating member can be known, whereby it is possible to interrupt the transmission of power to the movable member immediately after the movable member is abutted against the regulating member. To the contrary, if it is so designed that the movable member is advanced up to a predetermined position with predetermined pulses and thereafter the movable member is returned up to the reference position with predetermined pulses to abut it against the regulating member, it will be apt to generate the noise due to the out-of-phase of the motor. The reason is that, since the returning amount of the movable member is set excessively in anticipation of the error, the power is still transmitted to the movable member for a while after the movable member is abutted against the regulating member.

Further, at the initiation, when the shifting amount of the movable member is counted by the counting means, by decreasing the driving speed of the movable member, it is possible to obtain the more accurate counting, thus reducing the possibility of the out-of-phase of the motor due to the error, and the noise due to such out-of-phase.

By applying such movable member positioning apparatus to a copying system, it is possible to always stabilize the image forming position.

DESCRIPTION OF THE PREFERRED EMBODIMENTS

The present invention will now be explained in connection with embodiments thereof with reference to the accompanying drawings.

Figure 1:
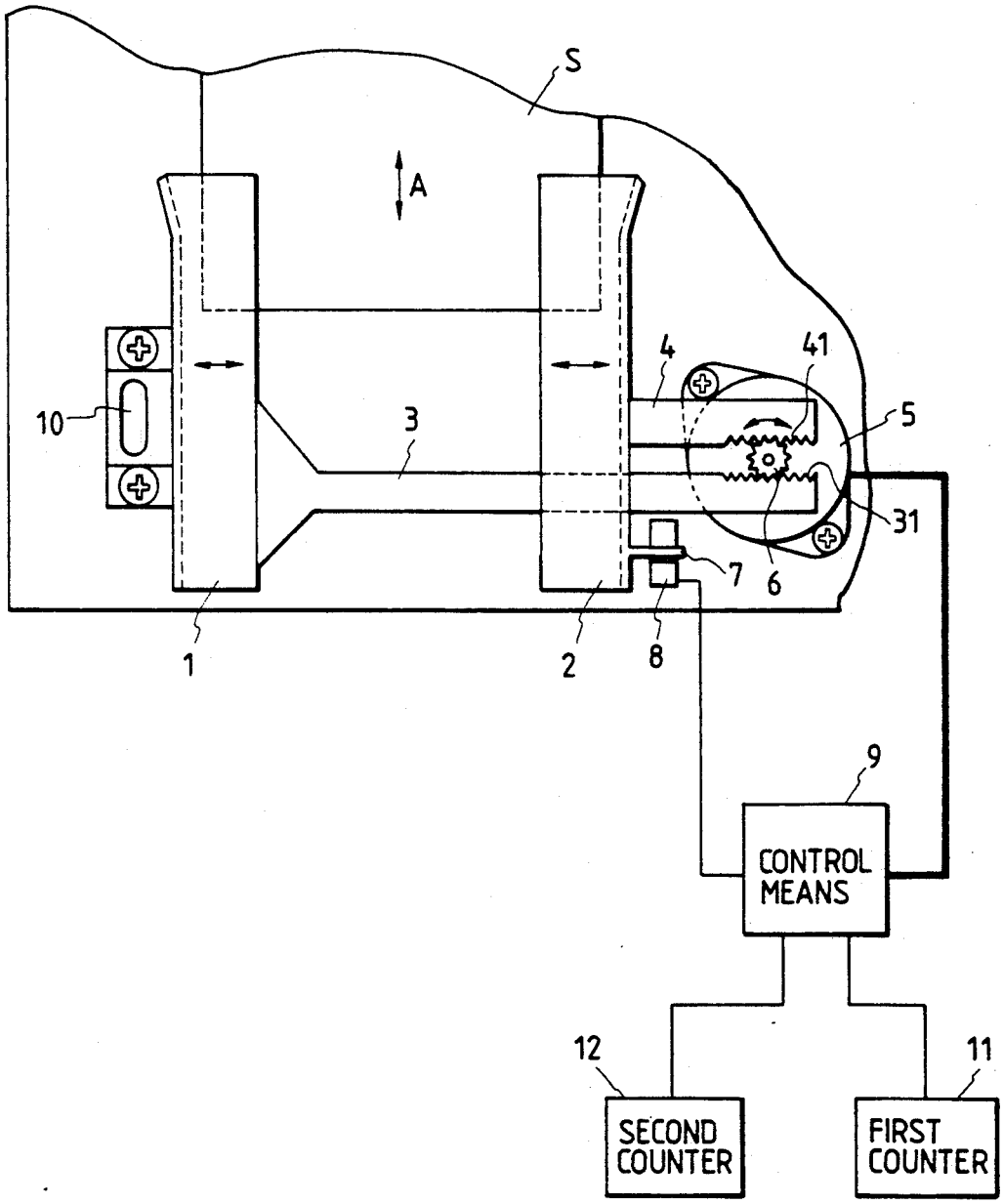
FIG. 1 is a constructural view showing a movable member positioning apparatus according to a first embodiment of the present invention.

FIG. 1 shows a construction of a movable member positioning apparatus according to a first embodiment of the present invention. In FIG. 1, on both sides of a sheet S conveyed in a direction shown by the arrow A, there are arranged movable plates 1, 2 acting as movable members shiftable in a transverse (width) direction of the sheet S. Plate members 3, 4 having rack gears 31, 41 are fixedly mounted on the movable plates 1, 2, respectively. A pinion gear 6 is attached to a rotary shaft of a stepping motor (driving source) 5. The rack gears 31, 41 are meshed with the pinion gear 6 so that, under the rotation of the stepping motor 5, the movable plates 1, 2 can be reciprocally shifted symmetrically in the transverse direction of the sheet S.

In FIG. 1, the reference numeral 10 denotes a regulating member for stopping the movable plate 1 at the reference position. On the other hand, a sensor flag 7 is protruded from the movable plate 2, so that, when the movable plate 2 is situated in the proximity of the reference position, the sensor flag 7 is detected by a sensor 8. The sensor flag 7 and sensor 8 constitutes a detection means.

A control means 9 includes first and second counters 11, 12 acting as a counting means and serves to control the shifting amounts of the movable plates 1, 2. The first counter 11 counts the shifting amount of the movable plate 2 while the sensor flag 7 is being detected by the sensor 8. The second counter 12 counts the shifting amount (from the reference position to a predetermined position) of the movable plate 2 when this movable plate is shifted in accordance with the width of the sheet to be set. It is so designed that the amount counted by the first counter 11 is greatly smaller than the amount counted by the second counter 12.

The control means 9 stores the counted value counted by the first counter 11, which counted value is used to control the returning of the movable plate to the reference position.

Figure 2:
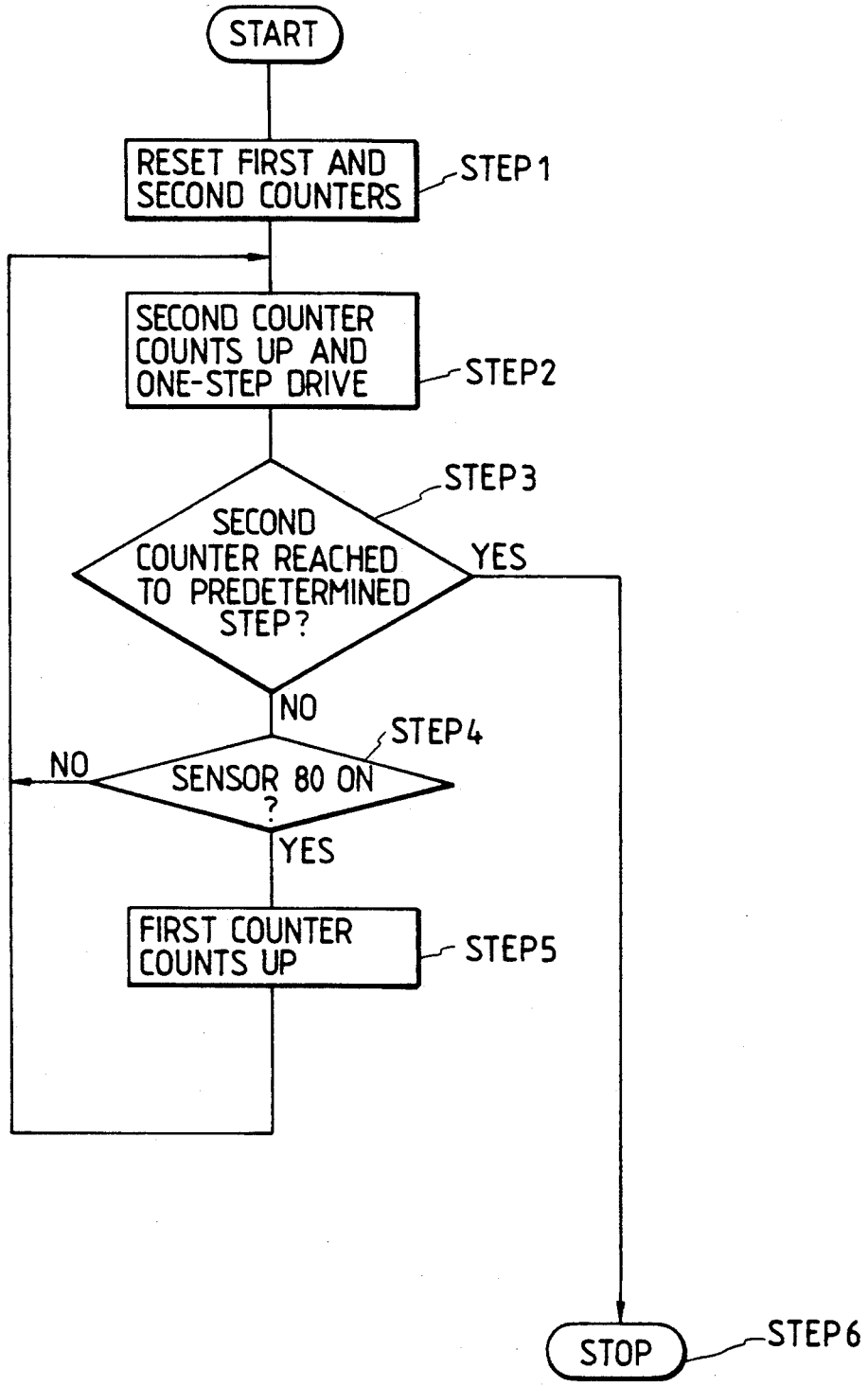
FIGS. 2 and 3 are flow charts showing an operation of the positioning apparatus of FIG. 1.
Figure 3:
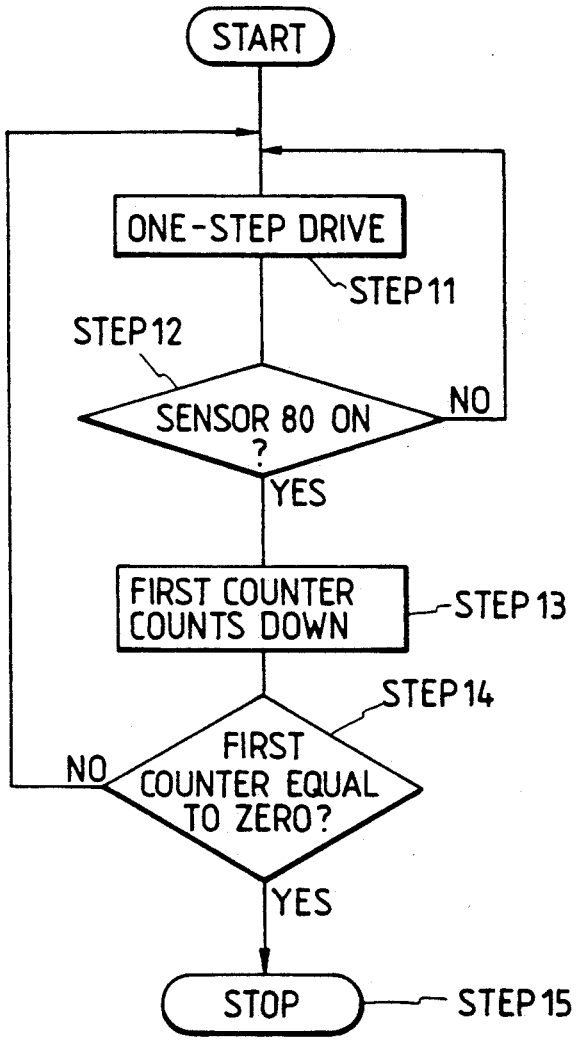

Now, an operation of the positioning apparatus so constructed will be fully described with reference to the flow charts shown in FIGS. 2 and 3.

First, when the movable plates 1, 2 are situated in the reference positions (home positions), the sensor 8 is detecting the sensor flag 7, and, thus, the sensor is under an ON condition. In this condition, when the driving is started, the control means 9 resets the second counter 12 for counting the number of steps corresponding to the set shifting amount (from the reference position) and the counter 11 for counting the number of steps when the sensor 8 is being turned ON in the proximity of the reference position (STEP 1). Then, one-step drive is effected to count up the second counter 12 (STEP 2).

In this case, since turn-on and turn-off delays can be expected when the sensor is turned from ON to OFF or from OFF to ON, in order to count the correct number of steps (shifting amount), it is preferable to decrease the driving speed of the movable plates to be slower than the normal driving speed within the range that the turn-on and turn-off of the sensor 8 is negligible, when the sensor 8 is detecting the sensor flag 7. This adjustment may be effected by the control means 9.

Then, it is judged whether the second counter 12 counts a predetermined number of steps (from the reference position to the predetermined position) corresponding to the width of the sheet (STEP 3); if affirmative, the driving is stopped (STEP 6). On the other hand, if negative, the sequence goes to a next STEP. In the next STEP, it is judged whether the sensor 8 is turned ON or OFF (STEP 4); if ON, the first counter 11 is counted up (STEP 5), whereas, if OFF, the sequence goes to next STEP. At the time when the above-mentioned series of operations are finished, the number of steps (shifting amount) counted from when the driving is started to when the sensor flag 7 of the movable plate 2 leaves the sensor 8 is stored in the first counter 11.

Now, a sequence for returning the movable plates to the reference positions will be explained with reference to the flow chart of FIG. 3.

First, one-step drive is effected (STEP 11) and then it is judged whether the sensor 8 is turned ON by the sensor flag 7 (STEP 12). If the sensor is not turned ON, the next one-step drive is effected. In the STEP 12, if the sensor is turned ON, the first counter 11 is counted down (STEP 13).

Next, in consequence of the count-down of the second counter 12, when the contents of the first counter 11 equals to zero, the driving is stopped; otherwise, the next one-step drive is effected again. In this case, it is so designed that, immediately before the contents of the first counter 11 becomes to zero, the movable plate 1 is abutted against the regulating member 10.

Incidentally, upon the initial movements of the movable plates and/or upon the reset of the first counter 11, the counted value of the first counter 11 is apt to be incorrect, and thus, the positions of the movable plates will be unstable. Thus, it is preferable to set the control means 9 so that, when the movable plates return to their reference positions, with reference to a distance of shifting movement of the movable plate 1 from when the sensor 8 detects the sensor flag 7 to when the movable plate 1 is abutted against the regulating member 10 disposed in the reference position, a correction value is calculated in consideration of the errors in the counter, sensor and the like and the first counter 11 counts the shifting amount on the basis of this correction value. By performing such control, the starting position of the movable plates at the initiation of the driving can be set correctly.

Further, when the movable plates are returned to the reference positions, by decreasing the driving speed of the movable plates after the sensor 8 is turned ON, upon the initial movements of the movable plates or even if there occurs in error in the number of steps counted by the counters, it is possible to reduce the impact noise upon striking of the movable plate 1 against the regulating member 10 and the deviation in the stopping position of the movable plate due to the rebound.

While an example that the count of the first counter 11 for every movement of the movable plate was explained, the control means may be so set that the first counter counts the shifting amount of the movable plate only at the first shifting movement of such movable plate and the counted value is stored in the control means 9, and the first counter does not count the shifting amount of the movable plate regarding the further shifting movements of the movable plate to the reference position. In this case, since the first counter 11 does not need to count the shifting amount of the movable plate after the second shifting movement of the movable plate and so on at the start of movement of such movable plate, there is no need to decrease the driving speed of the movable plate, thus reducing a bad influence upon the conveying speed of the sheet.

According to the movable plate positioning apparatus as mentioned above, when the movable plates are returned to their reference position, since the movable plates are always stopped at the same positions, the noise due to the out-of-phase of the stepping motor does not occur. The reason is that, since in the vicinity of the reference position a few number of pulses are counted down, the situation rarely occurs.

Figure 4:
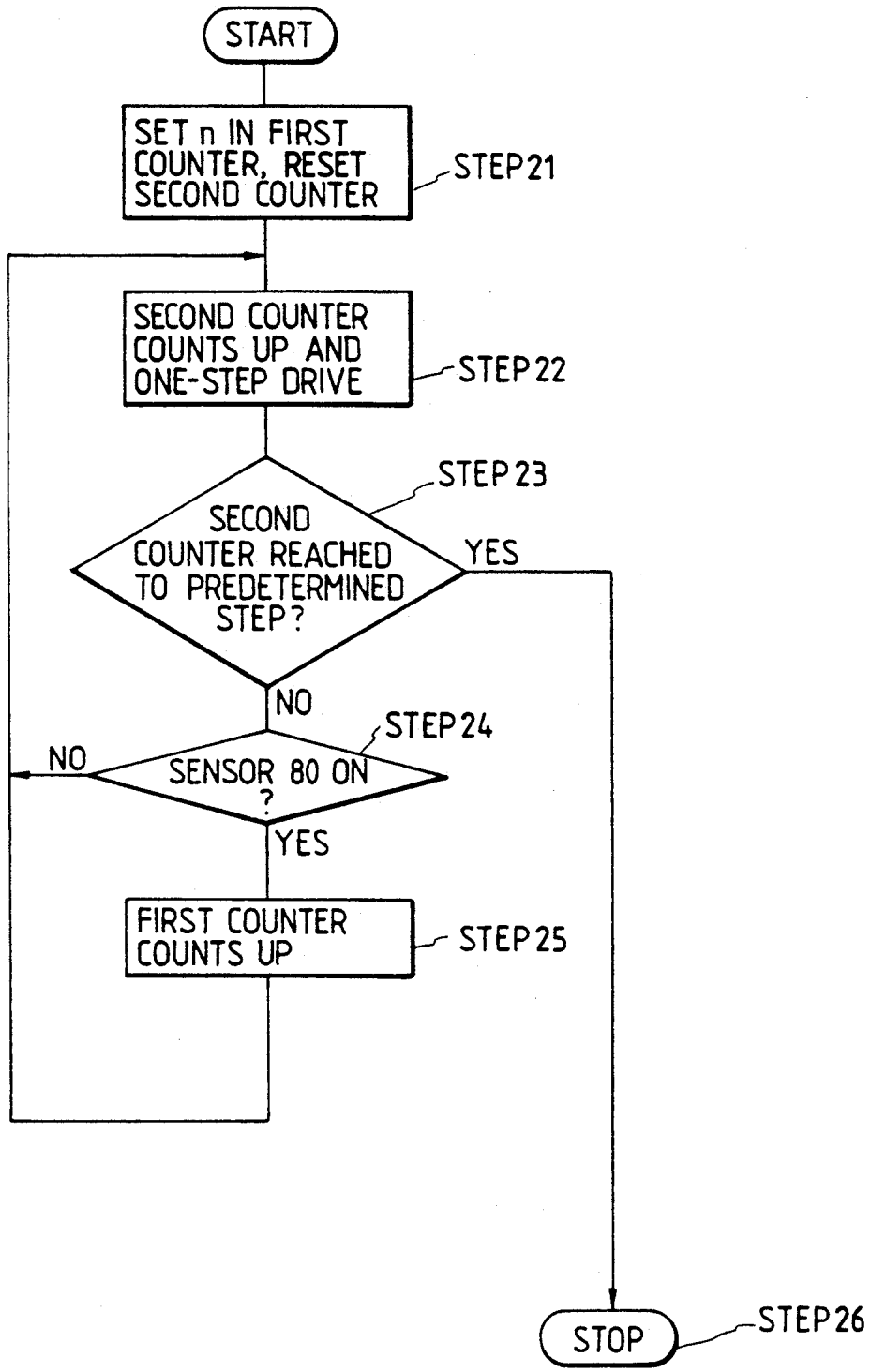
FIG. 4 is a flow chart showing an operation of a positioning apparatus according to a second embodiment of the present invention.

FIG. 4 shows a second embodiment of the present invention. Also in this second embodiment, since the fundamental construction is the same as that of the first embodiment shown in FIG. 1, FIG. 4 shows only a flow chart of an operation of the second embodiment.

In this second embodiment, at the initiation of the driving, a predetermined integral number n is previously set in the first counter 11 and the second counter 12 is reset to zero. The further sequence shown in FIG. 4 is the same as that of the first embodiment (FIG. 2).

In the second embodiment, since the number n is previously set in the first counter 11, when the movable plates are returned to their reference positions, the number of steps after the sensor 8 is turned ON is greater than the number of pulses counted at the normal rotation of the stepping motor by n pulses. Even when the counted value of the first counter 11 counted up in the STEP 5 in FIG. 2 regarding the above-mentioned first embodiment is fewer, according to the second embodiment, since + n steps drive is effected, the movable plates can be returned to the reference positions correctly. However, if the number n is selected too great, since the movable plate 1 tends to move after it is abutted against the regulating member 10 at the reference position, the stepping motor will be out-of-phase, thus generating the noise. Accordingly, if the stepping motor having N phases is used, it is preferable to set n < N. Further, the number + n may be set after the count-up of the first counter 11 is finished.

Next, a third embodiment of the present invention will be explained.

Figure 5:
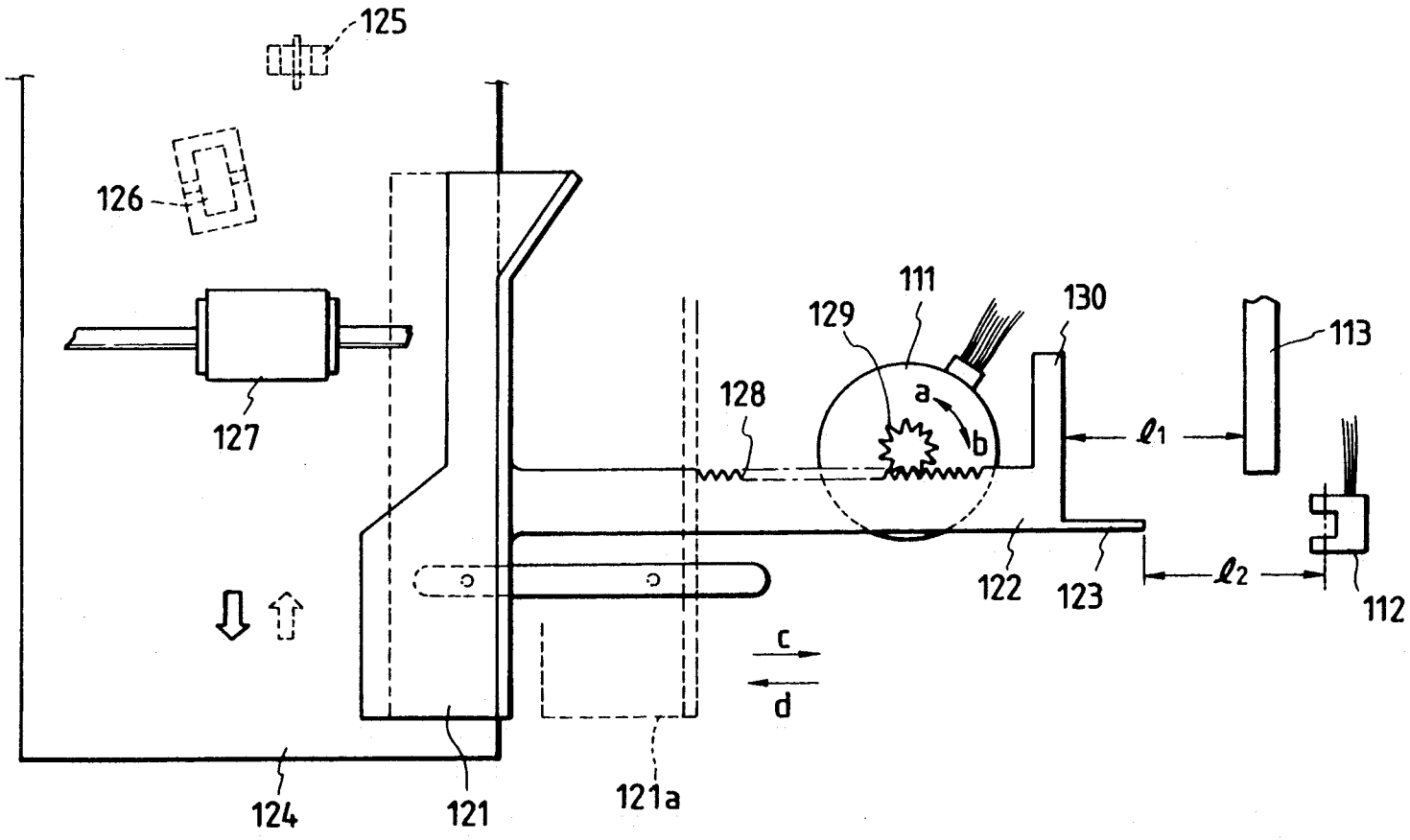
FIG. 5 is an explanatory view showing a concrete construction of a positioning apparatus according to a third embodiment of the present invention.

FIG. 5 is a schematic explanatory view showing a positioning apparatus for positioning a sheet in a recording system, according to the third embodiment of the present invention.

In FIG. 5, a movable plate 121 corresponding to the movable plate 1 shown in FIG. 1 is formed integrally with an extension 122 having a rack gear 128 and can be shifted in a direction shown by the arrow c or d under the rotation of a stepping motor 111. Now, the stepping motor 111 comprises a motor having four phases, and a gear meshed with the rack gear 128 is attached to a rotary shaft 129 of the stepping motor. Thus, the movable plate 121 is shifted under the rotation of the rotary shaft 129. A projection 123 formed on an end of the extension 122 cooperates with a photo-sensor 112 (corresponding to the sensor 8) to shield the light of the latter when the movable plate 121 is shifted in the direction c to approach the reference position (shown as a position of the movable plate 121*a*), thus permitting the detection of the position of the movable plate. A reference plate 113 for regulating the shifting movement of the movable plate 121 corresponds to the regulating member 10 shown in FIG. 1. The reference plate 113 serves to regulate the further movement of the movable plate 121 to the direction c by engaging with a protrusion 130 formed on the extension 122 near the photosensor.

A sheet 124 is regulated at its lateral edge by the movable plate 121 so that a shifting direction of the sheet can be adjusted. The reference numeral 125 denotes a sheet sensor for detecting the presence/absence of the sheet. A skew-feed roller 126 biases the sheet 124 toward the movable plate 121 and cooperates with the movable plate 121 to regulate the conveying direction of the sheet 124. The reference numeral 127 denotes a conveying roller to effect the reverse movement of the sheet 124.

Now, the positioning of the sheet in the positioning apparatus will be fully explained.

The timing for positioning the sheet 124 is effected when the sheet 124 is reversely conveyed to record an image on the second surface of the sheet after an image is recorded on the first surface of the sheet in a both-surface recording mode. First, in a condition that the movable plate 121 is situated in the reference position, the sheet 124 is conveyed in a direction shown by the solid arrow. When the sheet sensor 125 detects the fact that the sheet 124 is conveyed, a control means (corresponding to the control means 9 in FIG. 1) rotates the stepping motor 111 in the direction b, thus shifting the movable plate 121 in the direction d by a predetermined amount. At the same time, the skew-feed roller 126 is rotatingly driven to convey the sheet 124 to abut it against the movable plate 121, thus positioning the sheet 124. In this case, the position of the movable plate 121 differs in accordance with the sizes of the sheets, and it is so selected that a center of any sheet coincides with a central reference in the image forming portion.

Further, the control means rotates the conveying roller 127 after a predetermined time period has been elapsed, thus conveying the sheet 124 in a direction shown by a phantom line to reverse the positioned sheet. The conveyed sheet is directed again to the image forming portion through a refeeding path. The conveying roller 127 comprises a semi-circular roller which becomes free with respect to the sheet 124 upon the positioning the sheet 124. In this way, when the conveying roller 127 is rotated by the predetermined amount, the stepping motor 111 is rotated in the direction a by the predetermined amount, thus shifting the movable plate 121 in the direction c to be returned to the reference position (home position).

In this embodiment, by increasing the positioning accuracy of the movable plate 121 to the reference position (shown by the broken line 121*a*), it is possible to increase the positioning accuracy of the sheet 124.

Next, an image forming system to which the present invention is applied will be explained.

Figure 6:
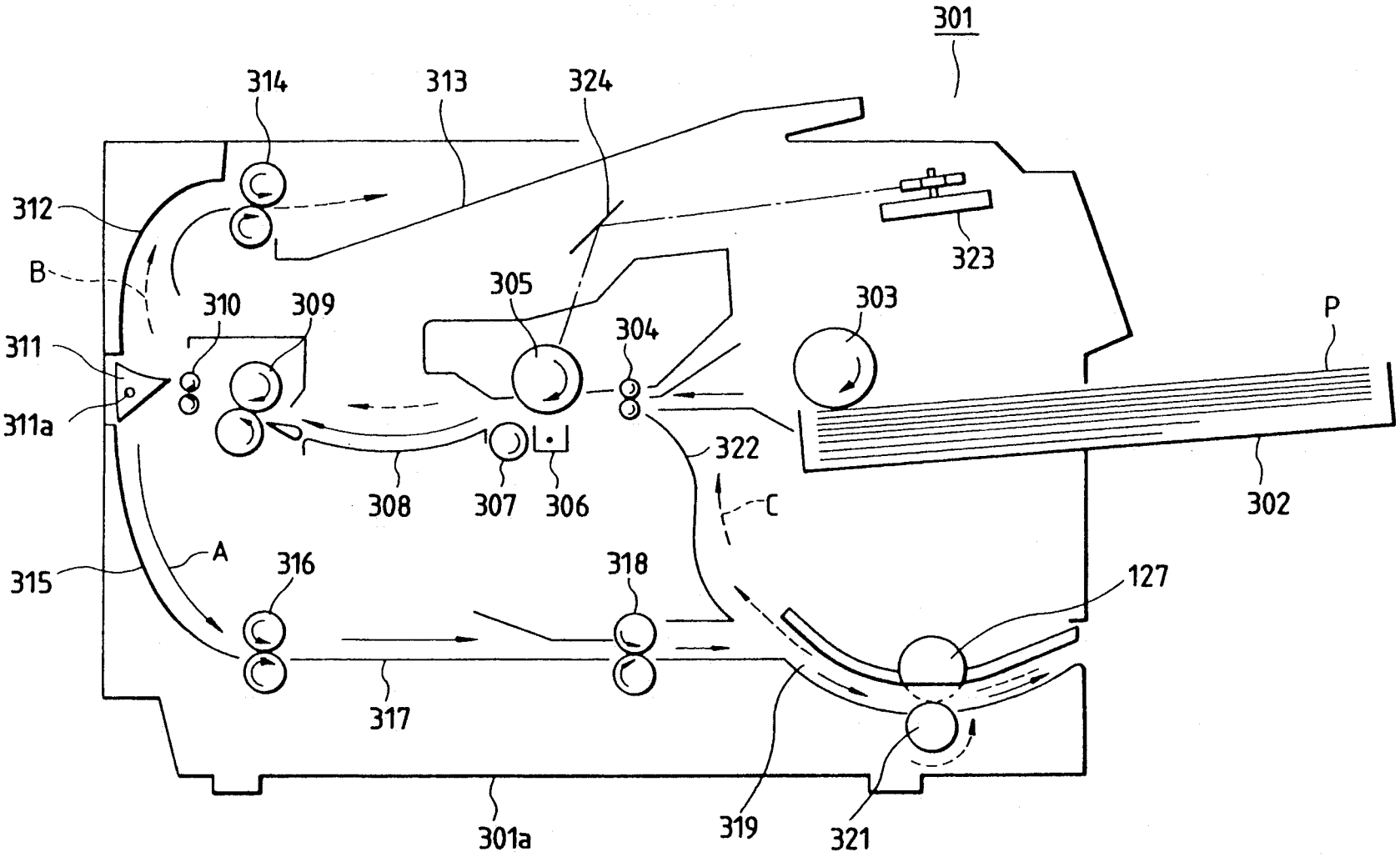
FIG. 6 is an elevational sectional view of an image forming system to which the present invention is applied.

FIG. 6 shows a laser beam printer 301. A cassette 302 storing sheet members P is inserted and set in the right wall of the printer 301. The printer 301 includes a sheet supply roller 303, regist roller 304, a photosensitive drum 305, a transfer charger 306, a convey roller 307, a convey unit 308 comprising a conveyor, a pair of fixing roller 309, convey rollers 310, and a flapper 311 axially supported on a shaft 311*a*. A guide 312 is arranged above the flapper 311. The end portion of the guide 312 is open to a tray 313 arranged on the upper surface of a main body 301*a*, and exhaust rollers 314 are arranged at this end portion.

A guide 315 is arranged to extend below the flapper 311. Convey rollers 316 are arranged at the end portion of the guide 315, and convey rollers 318 are arranged at a downstream portion of a horizontal guide 317 following the guide 315.

A guide 319 which is curved upward extends from the end portion of the horizontal guide 317 through the right wall of the main body 301*a*. The guide 319 has a U-shaped section. The shape of the guide 319 conforms to not that of the guide 317 but that of a guide 322. A semi-circular roller 127 which can be rotated in both normal and reverse directions is arranged between the lateral regist plates and a rotatable roller 321 is arranged to oppose the roller 127. The guide 322 which is curved upward extends from the guide 19 to the regist rollers 304. A light beam scanned by a polygonal scanner 323 is guided to the photosensitive drum 305 by a mirror 324.

The operation of this embodiment will be described below.

A sheet member P supplied from the cassette 302 by the sheet supply roller 303 is conveyed by the regist rollers 304 in synchronism with the timing of the photosensitive drum 305, and an image formed on the photosensitive drum 305 is transferred onto the sheet member P. The image transferred onto the sheet member P is fixed by the pair of fixing rollers 309 via the convey unit 308. The sheet member P is then guided by the convey rollers 309 to the flapper 311.

When images are printed on two surfaces of the sheet member P, the sheet member P on the first surface of which an image is printed is conveyed in a direction of an arrow A by the flapper 311 at a solid line position in FIG. 6, and is then guided toward guides 319 by the convey rollers 316 and 318.

The roller 127 is then rotated in a direction of a broken arrow to switch back the sheet member P and to smoothly convey it onto the guide 322 in a direction of an arrow C in FIG. 6.

In the above-mentioned embodiments (FIGS. 1 and 5), while an example that the conveying direction of the sheet is regulated was explained, the present invention is not limited to this example, but can be applied to the positioning of a carriage of a printer to its home position and positioning of various conveyed members.

Next, one of such examples will be explained.

Figure 7:
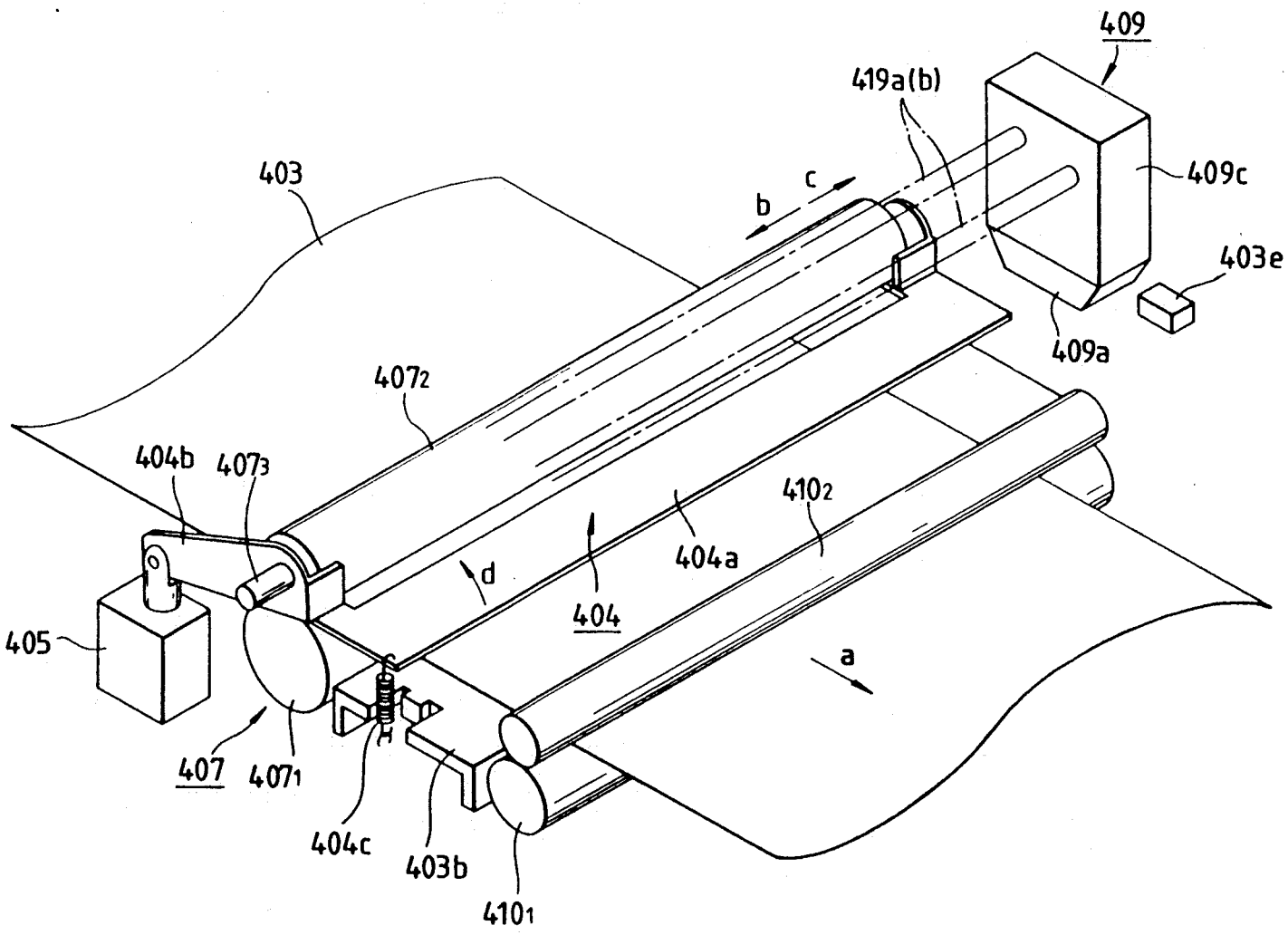
FIG. 7 is a perspective view of a head carriage mechanism to which the present invention is applied.

FIG. 7 is a perspective view of a recording apparatus including means for preventing the floating a predetermined image is recorded on the recording sheet 403 by injecting the ink droplets from the recording head 409*a* in response to an image signal. A home position sensor 403*e* for detecting a home position of the carriage 409*c* is arranged in the home position of the carriage.

A sheet hold-down member 404 comprises a plate-shaped hold-down portion 404*a* and arm portions 404*b* formed on both ends of the hold-down portion. The arm portions are rotatably mounted on a roller shaft $407_3$ of the first conveying roller $407_2$. By a tension spring 404*c* connected to the hold-down portion 404*a*, the latter can urge the recording sheet 403 against the platen 403*b*.

The sheet hold-down member 404 can be abutted against and separated from the recording sheet 403 by urging/retracting means which, in the illustrated embodiment, is constituted by a solenoid 405. More particularly, the solenoid 405 is attached to an end of the arm portion 404*b*, and, when the solenoid 405 is turned ON, the arm portion 404*b* is rotated in the direction shown by the arrow d, thus separating the hold-down portion 404*a* from the recording sheet 403. On the other hand, when the solenoid 405 is turned OFF, the hold-down portion 404*a* is pulled by the spring 404*c* to urge the recording sheet 403 against the platen 403*b*. The hold-down member is inclined down rightwardly.

In the embodiment shown in FIG. 7, the sensor 403*e* corresponds to the sensor 8 shown in FIG. 1, and the head 409 corresponds to the sensor flag 7.

Next, the recording means of the example shown in FIG. 7 will be explained.

The recording means serves to record the ink image on the sheet conveyed by the conveying means. As the recording means of this apparatus, an ink jet recording process is preferably used.

An ink jet recording head includes liquid discharge openings for discharging the recording ink liquid as flying ink droplets, liquid passages communicated with the corresponding discharge openings, and discharge energy generating means for applying discharge energy to the ink liquid in the respective passages to form the flying droplets. By selectively energizing the discharge energy generating means in response to the image signal, the ink droplets are discharged to form the image on the sheet.

The discharge energy generating means may be, for example, a pressure energy generating means using electrical/mechanical converter elements such as piezo electric elements, an electromagnetic energy generating means for discharging the ink by applying the electromagnetic wave such as laser to the ink liquid so as to heat the ink liquid, or a thermal energy generating means for discharging the ink liquid by heating the ink liquid by means of electrical/thermal converter elements. Among them, the thermal energy generating means using electrical/thermal converter elements is most preferable since the discharge openings can be arranged with high density to perform the recording with high resolving power and the recording head can be compacted.

In the illustrated embodiment, jet recording heads of serial-type which are one kind of the ink jet recording heads are used as the image recording means.

Figure 8:
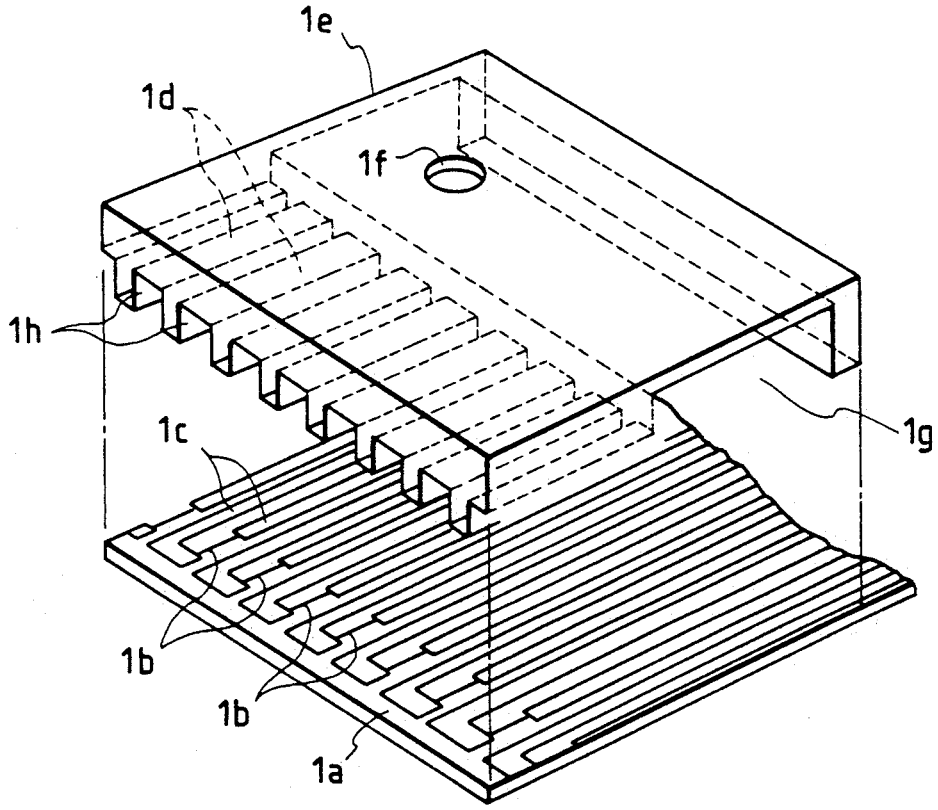
FIG. 8 is an exploded perspective view of a recording head.

FIG. 8 shows an exploded perspective view of the recording head 1 constituting the recording means, and FIGS. 9A to 9G show a principle of the jet recording process. Typical constructions and principles thereof are disclosed, for example, in U.S. Pat. Nos. 4,723,129 and 4,740,796.

In FIG. 8, the reference numeral 1*a* denotes a heater board wherein electrical/thermal converters (discharge heaters) 1*b* and electrodes 1*c* made of aluminium which supply electric powers to the electrical/thermal converters are formed on a silicon substrate by a film forming process. A top plate 1*e* having partition walls for defining recording liquid passages (nozzles) 1*d* is adhered to the heater board 1*a*. Further, an ink cartridge (not shown) for supplying the ink to the recording head 1 is removably mounted on the head in place.

The ink supplied from the ink cartridge to the recording head via a liquid supply tube (not shown) is directed to a common liquid chamber 1*g* in the head 1 through a supply opening 1*f* formed on the top plate 1*e* and then is sent to the nozzles 1*d* from the common liquid chamber 1*g*. The nozzles 1*d* have ink discharge openings $1d_l$, respectively, which are disposed at a predetermined pitch along a sheet feeding direction in confronting relation to the sheet.

In the illustrated embodiment, the recording head 1 is mounted on a reciprocable carriage and the recording is performed by discharging the ink from the recording head 1 in synchronous with the shifting movement of the carriage.

Next, a principle for forming the flying droplet in the jet recording process will be explained with reference to FIGS. 9A to 9G.

Figure 9A:
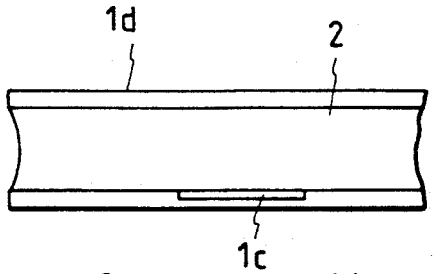
FIGS. 9A to 9G are explanatory views for explaining a bubble jet recording principle.
Figure 9B:
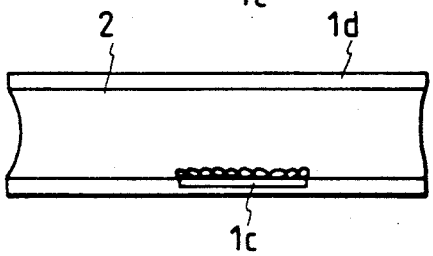
Figure 9C:
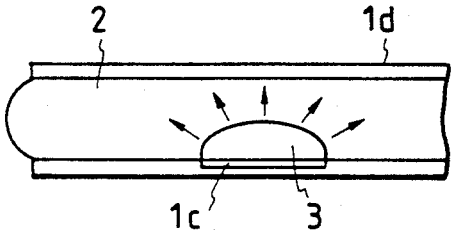

In the steady-state, as shown in FIG. 9A, a tension force of the ink 2 filled in the nozzle 1*d* is equilibrated with the external force at an discharge opening surface. In this condition, when the ink is desired to fly, the electrical/thermal converter 1*b* disposed in the nozzle 1*d* is energized to abruptly increase the temperature of the ink in the nozzle 1*d* exceeding the nucleate boiling. Consequently, as shown in FIG. 9B, the ink portion adjacent to the electrical/thermal converter 1*b* is heated to create a fine bubble, and then the heated ink portion is vaporized to generate the film boiling, thus growing the bubble 3 quickly, as shown in FIG. 9C.

Figure 9D:
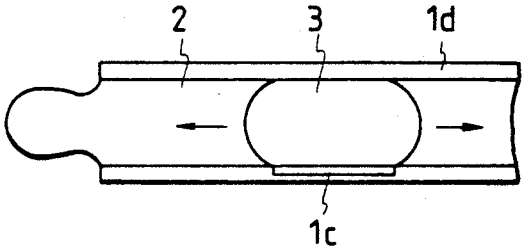
Figure 9E:
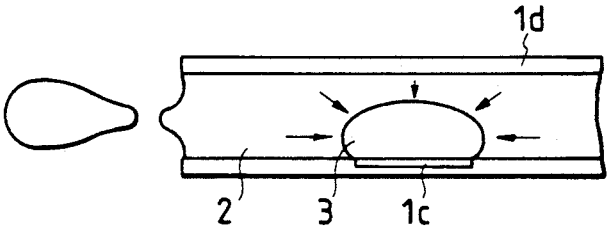
Figure 9F:
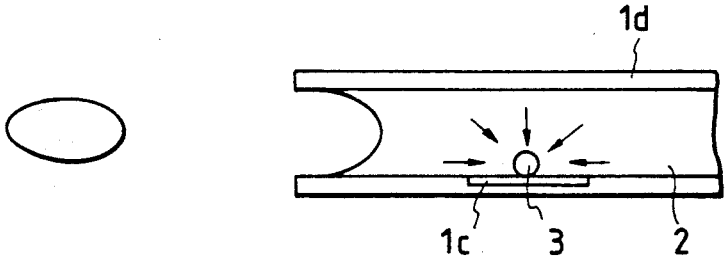
Figure 9G:
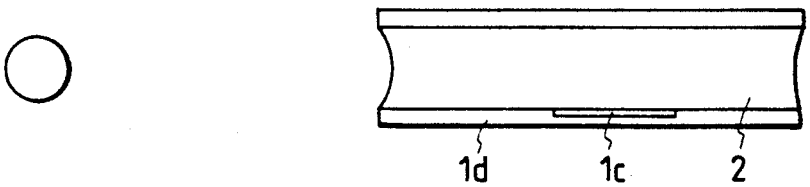

When the bubble 3 is grown at the maximum extent as shown in FIG. 9D, the ink droplet is pushed out of the discharge opening of the nozzle 1*d*. When the electrical/thermal converter 1*b* is disenergized, as shown in FIG. 9E, the grown bubble 3 is cooled by the ink 2 in the nozzle 1*d* to contract. Thus, the growth and contraction of the bubble, the ink droplet is flying from the discharge opening. Further, as shown in FIG. 9F, the ink contacted with the surface of the electrical/thermal converter 1*b* is quickly cooled, thus diminishing the bubble 3 or reduce the volume of the bubble to the negligible extent. When the bubble 3 is diminished, as shown in FIG. 9G, the ink is replenished in the nozzle 1*d* from the common liquid chamber 1*g* by a capillary phenomenon, thus preparing the next formation of the ink droplet.

Accordingly, by selectively energizing the electrical/thermal converters 1*b* in response to the image signal, the ink image can be recorded on the sheet.

What is claimed is:

1. A movable member positioning apparatus, comprising:

a movable member reciprocally drivable between a reference position and a predetermined position;

detection means for detecting that said movable member is in the proximity of said reference position;

counting means for counting an amount by which said movable member is shifted from the reference position while said detection means is detecting that said movable member is in the proximity of said reference position; and control means for storing a count value counted by said counting means and for controlling drive of said movable member toward said reference position on the basis of said stored count value.

2. A movable member positioning apparatus according to claim 1, wherein, upon an initial shifting movement of said movable member or upon the reset of said counting means, a correction value for correcting a mechanical error occurred from when said movable member is detected by said detection means to when said movable member reaches said reference position is set in said control means.

3. A movable member positioning apparatus according to claim 1, wherein a driving speed of said movable member is set to be slower than a normal driving speed, when said detection means is detecting said movable member.

4. A movable member positioning apparatus according to claim 1, wherein said movable member acts as a guide member for guiding a lateral edge of a sheet in an image forming system.

5. A movable member positioning apparatus according to claim 4, further including a regulating member for stopping the shifting movable member at said reference position by abutting said movable member thereagainst.

6. A movable member positioning apparatus according to claim 1, wherein said movable member acts as a head carriage in an image forming system.

7. A movable member positioning apparatus according to claim 6, wherein said image forming system comprises a printer.

8. A movable member positioning apparatus according to claim 7, wherein said image forming system comprises an ink jet recording system in which a recording means discharges ink in response to an image signal to perform the recording.

9. A movable member positioning apparatus according to claim 8, wherein said image forming system comprises an ink jet recording system in which a recording means energizes an electrical/thermal converter in response to an image signal to perform the recording by discharging the ink by the use of thermal energy from said electrical/thermal converter.

10. A movable member positioning apparatus according to claim 8, wherein said image forming system comprises an ink jet recording system in which a recording means energizes an electrical/thermal converter in response to an image signal to perform the recording by discharging the ink from a discharge opening by the growth of a bubble generated by heating the ink by means of said electrical/thermal converter to exceed the film boiling.

11. A movable member positioning apparatus according to claim 1, wherein said control means controls drive of said movable member toward said reference position on the basis of said stored counted value and on the count in said counting means.

12. A movable member positioning apparatus comprising:

a movable member reciprocally drivable between a reference position and a predetermined position;

first counting means for counting an amount by which said movable member is shifted from the reference position while said movable member is in the proximity of said reference position;

second counting means for counting an amount by which said movable member is shifted from said reference position to said predetermined position;

control means for storing a count value counted by said first counting means and for controlling drive of said movable member toward said reference position on the basis of said stored count value; and an abutment regulating member for stopping said movable member at said reference position.

13. A movable member positioning apparatus according to claim 12, wherein said control means controls drive of said movable member toward said reference position on the basis of said stored counted value and on the count in said first counting means.

14. A movable member positioning apparatus comprising:

a movable member reciprocally drivable between a reference position and a predetermined position;

first counting means for counting an amount by which said movable member is shifted from said reference position while said movable member is in the proximity of said reference position;

second counting means for counting an amount by which said movable member is shifted from said reference position to said predetermined position; and control means for storing a count value counted by said first counting means and for controlling drive of said movable member toward said reference position on the basis of said stored count value.

15. A movable member positioning apparatus according to claim 14, wherein the count by said first counting means when said movable member is shifted from said reference position to said predetermined position is effected only once at the first time, and the counted value is stored in a memory.

16. A movable member positioning apparatus according to claim 14, further comprising drive means including a stepping motor for reciprocally driving said movable member, and wherein said first and second counting means include light receiving element slits and a sensor flag, respectively.

17. A movable member positioning apparatus according to claim 14, wherein said control means controls drive of said movable member toward said reference position on the basis of said stored counted value and on the count in said first counting means.

* * * * *

UNITED STATES PATENT AND TRADEMARK OFFICE

CERTIFICATE OF CORRECTION

PATENT NO. : 5,172,138

DATED : December 15, 1992

INVENTOR(S) : OKAZAWA, et al.

It is certified that error appears in the above-indentified patent and that said Letters Patent is hereby corrected as shown below:

On title page, item

[56] Foreign Patent Documents
"169436 3/1989 Japan" should read --1-69436 3/1989 Japan--.

COLUMN 1
Line 55, "provide" should read --provides--.

COLUMN 3
Line 15, "constitutes" should read --constitute--.

COLUMN 4
Line 40, "in error" should read --an error--.
Line 46, "11 for" should read --11 is effected for--.

COLUMN 6
Line 48, "roller 309," should read --rollers 309,--.

COLUMN 8
Line 48, "openings 1d$_l$" should read --openings 1h--.

UNITED STATES PATENT AND TRADEMARK OFFICE

CERTIFICATE OF CORRECTION

PATENT NO. : 5,172,138

DATED : December 15, 1992

INVENTOR(S) : Okazawa, et al

It is certified that error appears in the above-indentified patent and that said Letters Patent is hereby corrected as shown below:

Column 8, line 55, "synchronous" should read --synchronism--

Signed and Sealed this

Eighth Day of February, 1994

Bruce Lehman

*Attest:*

BRUCE LEHMAN

*Attesting Officer*

*Commissioner of Patents and Trademarks*